US006542129B1

(12) United States Patent
Bien et al.

(10) Patent No.: US 6,542,129 B1
(45) Date of Patent: Apr. 1, 2003

(54) ELEVATION POSITIONING CRADLE FOR MICROWAVE ANTENNA

(75) Inventors: Albert Louis Bien, Anaheim, CA (US); Glenn J. Desargant, Fullerton, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/975,877

(22) Filed: Oct. 12, 2001

(51) Int. Cl.[7] ..... H01Q 3/08
(52) U.S. Cl. ..... 343/766; 343/765
(58) Field of Search ..... 343/766, 757, 343/761, 763, 765; H01Q 3/08

(56) References Cited

U.S. PATENT DOCUMENTS 4,345,256 A * 8/1982 Rainwater ..... 343/754
4,814,781 A * 3/1989 DeHaven ..... 343/766
4,937,587 A * 6/1990 Tsuda ..... 343/756
6,188,367 B1 * 2/2001 Morrison et al. ..... 343/765

* cited by examiner

*Primary Examiner*—Hoanganh Le
(74) *Attorney, Agent, or Firm*—Harness, Dickey & Pierce, P.L.C.

(57) ABSTRACT

A microwave reflector antenna comprises a rotary plate that rotates about an azimuth axis. At least one elevation cradle is attached to the rotary plate to provide an elevation axis and rotates about the azimuth axis with the rotation of the rotary plate. The at least one elevation cradle has a curved guide with a plurality of ball bearings to facilitate the rotation of the reflector about the elevation axis. A reflector travels along the at least one cradle as the reflector rotates about the elevation axis. The reflector rotates about the azimuth axis with the rotation of the at least one cradle. The rotation of the reflector about the azimuth axis and about the elevation axis define a swept volume of the reflector. The at least one cradle is positioned on the rotary plate so that the at least one cradle is within the swept volume of the reflector.

20 Claims, 4 Drawing Sheets

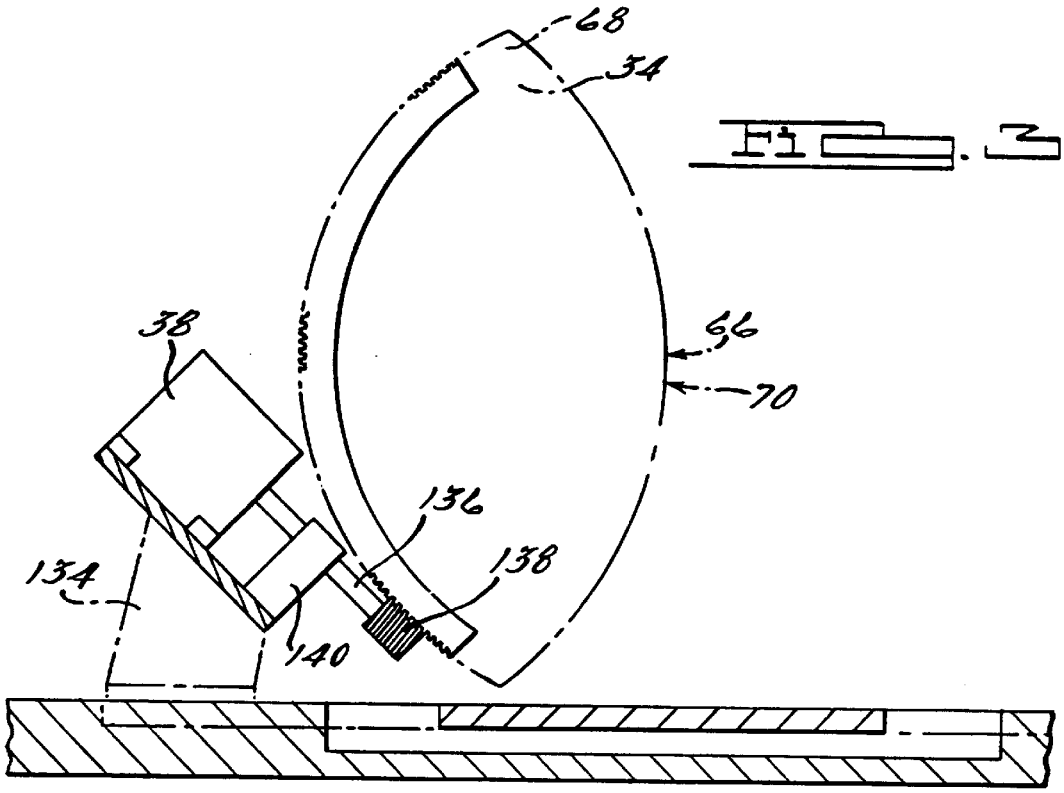
FIG. 3.
FIG. 6.
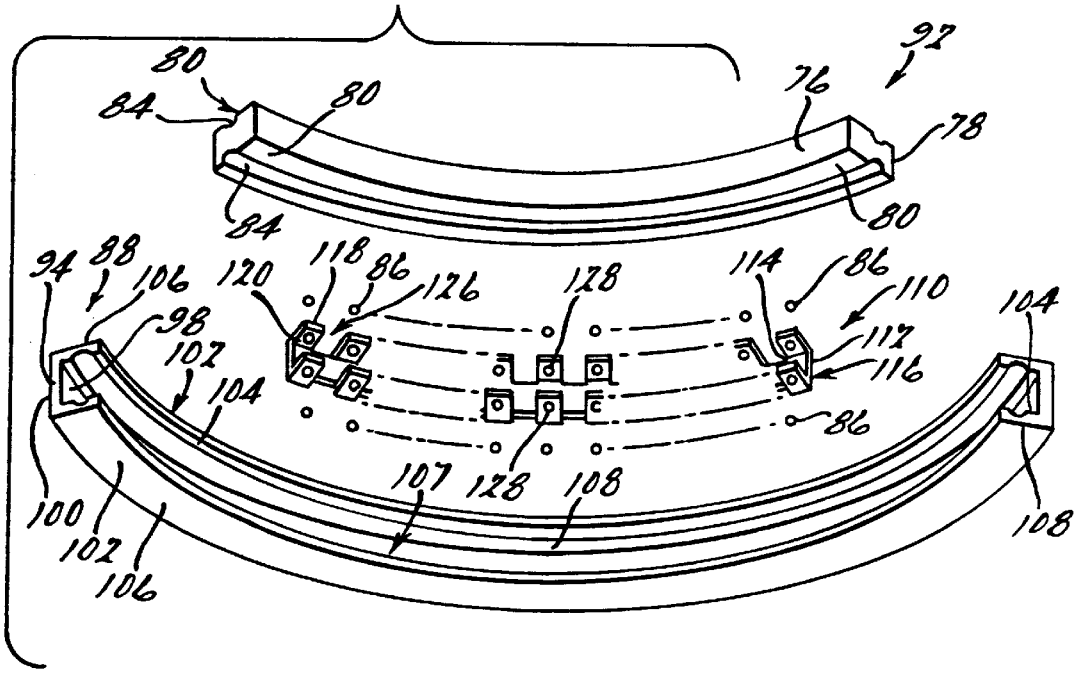

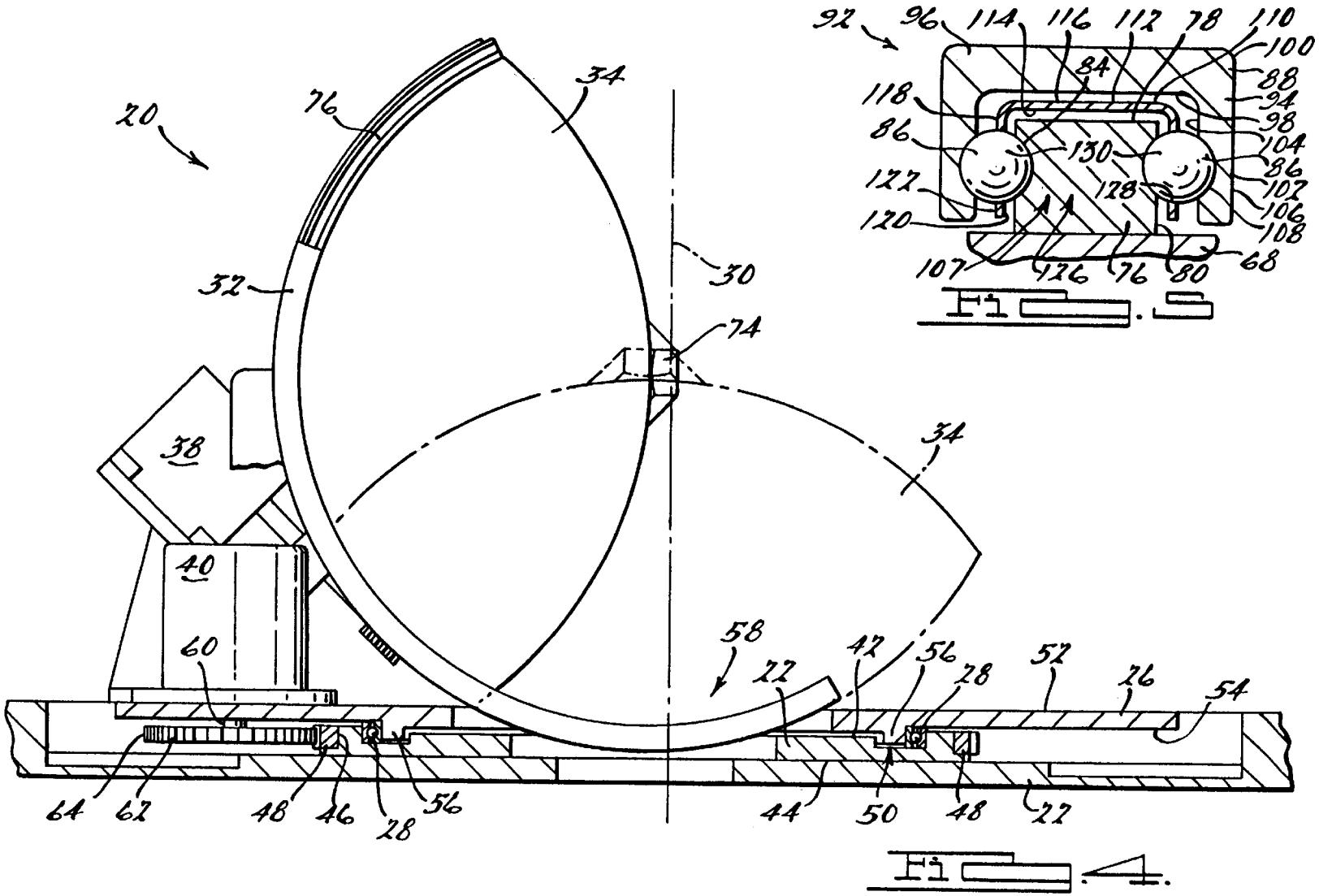
110
100
88
94
98
104
86
102
106
108
68
78
112
116
84
114
96
92
118
86
122
120
107
80
76
126
130
128
54
76
52
22
48
28
56
42
50
44
22
58
34
30
74
34
76
32
38
40
60
20
56
28
46
48
62
64

ELEVATION POSITIONING CRADLE FOR MICROWAVE ANTENNA

FIELD OF THE INVENTION

The present invention relates to microwave reflector antenna and, more specifically, to microwave reflector antenna that rotate about both an azimuth axis and an elevation axis.

BACKGROUND OF THE INVENTION

Microwave reflector antennas can be used in a variety of applications. For example, microwave reflector antennas can be used on an aircraft to allow the aircraft to communicate with other parties. When a microwave reflector antenna is used on an aircraft, the microwave reflector antenna is typically positioned on the crown of the exterior of the aircraft. The positioning of the microwave reflector antenna on the exterior of the aircraft increases the drag of the aircraft as it travels through the atmosphere and could expose the microwave reflector antenna to the harsh environment that the aircraft is exposed to. Therefore, the microwave reflector antennas are typically covered by a radome which completely covers the microwave reflector antenna and reduces the drag caused by positioning the microwave reflector antenna on the exterior of the aircraft.

The radome is designed to cover the microwave reflector antenna and to reduce the drag on the aircraft caused by the microwave reflector antenna. To achieve a reduction in the drag on the aircraft associated with covering a microwave reflector antenna with a radome, the radome is gradually tapered from its peak to its ends. The typical radome will have a length along the aircraft of approximately 10 to 12 inches for every inch of height for which the radome must extend above the aircraft to cover the microwave reflector antenna. The typical microwave reflector antenna requires a radome of approximately 10 to 12 feet or more in length to cover the microwave reflector antenna.

Because the cost of the radome is proportional to the size of the radome, any reduction in the height or size of the radome and the resulting length of the radome will result in a cost savings. Additionally, a decrease in the size of the radome will also decrease the drag caused by the radome on the aircraft. Therefore, it is desirable to reduce the size of the microwave reflector antenna so that the size of the radome can also be reduced.

The typical microwave reflector antenna has a reflector that is capable of rotating about two different axes. The first axis of rotation is the azimuth axis. Rotation of the reflector about the azimuth axis allows the reflector to rotate 360° so that the reflector can point in any direction along the horizon. The second axis of rotation is the elevation axis. Rotation of the reflector about the elevation axis allows the elevation of the reflector to be adjusted so that the reflector can be orientated between the horizon and the sky.

The typical microwave reflector antenna has a stationary or base plate that is attached to the aircraft and remains stationary relative to the aircraft. A rotary plate rotates relative to the stationary plate about the azimuth axis. The reflector of the microwave reflector antenna is connected to the rotary plate so that rotation of the rotary plate about the azimuth axis causes the reflector to rotate about the azimuth axis. The reflector is typically connected to the rotary plate by elevation bearings that allow the reflector to rotate about the elevation axis. The elevation bearings are typically located on opposite peripheral sides of the reflector antenna so that the reflector antenna is positioned between a pair of elevation bearings.

The rotation of the microwave reflector antenna about both the azimuth axis and the elevation axis define a swept volume of the microwave reflector antenna through which the microwave reflector antenna must be able to freely move in order for the microwave reflector antenna to operate correctly. That is, the swept volume of the microwave reflector antenna represents the volume of space that allows all the components of the microwave reflector antenna to operate throughout their entire range of motion. Therefore, a radome designed to cover the microwave reflector antenna must not interfere with or encroach upon the swept volume of the microwave reflector antenna.

The individual component of the microwave reflector antenna which encompasses the largest volume of the swept volume of the microwave reflector antenna is the reflector. The reflector swept volume should represent the minimum swept volume that can be attained for the microwave reflector antenna. That is, if each of the other components of the microwave reflector antenna can be positioned so that the swept volume of each of the other components is within the swept volume of the reflector, the swept volume of the reflector would be the same as the swept volume of the microwave reflector antenna. Therefore, in order to reduce the swept volume of the microwave. reflector antenna and the associated size of the radome, it is desirable to position the components of the microwave reflector antenna so that the swept volume of the components are within the swept volume of the reflector.

The elevation bearings are typically located on the periphery of the reflector. Because the elevation bearings are located on the periphery of the reflector, the elevation bearings are not within the reflector swept volume and therefore increase the swept volume of the microwave reflector antenna. The elevation bearings thereby require the radome to encompass a swept volume that is larger than the reflector swept volume. Therefore, it is desirable to locate the elevational bearings within the reflector swept volume so that the elevational bearings do not cause the microwave reflector antenna swept volume to be larger than the reflector swept volume.

Therefore, what is needed is a microwave reflector antenna that has as many of its components as possible to be within the reflector swept volume so that the microwave reflector antenna swept volume is minimized. The minimization of the microwave reflector antenna swept volume allows for a smaller radome and an associated savings in cost and drag on the aircraft.

SUMMARY OF THE INVENTION

The microwave reflector antenna of the present invention is designed with a reduced swept volume so that a radome covering the microwave reflector antenna can be of minimal size.

The reduced swept volume microwave reflector antenna of the present invention generally comprises a rotary plate that is capable of being rotated about an azimuth axis. At least one elevation cradle is attached to the rotary plate so that rotation of the rotary plate about the azimuth axis causes the at least one cradle to rotate about the azimuth axis. A reflector is connected to the at least one cradle and travels along the at least one cradle as the reflector rotates about an elevation axis. The reflector also rotates about the azimuth axis with the rotation of the at least one cradle about the azimuth axis. The rotation of the reflector about the azimuth axis and about the elevation axis define a swept volume of the reflector. The at least one cradle is positioned on the rotary plate so that the at least one cradle is within the swept volume of the reflector. The positioning of the at least one cradle within the swept volume of the reflector prevents the at least one cradle from causing the swept volume of the microwave reflector antenna to be larger than the reflector swept volume.

In another aspect of the present invention, a microwave reflector antenna with a reduced swept volume has a rotary plate that is capable of rotating about an azimuth axis. At least one elevation cradle is attached to the rotary plate so that rotation of the rotary plate about the azimuth axis causes the at least one cradle to rotate about the azimuth axis. The at least one cradle has a curved guide. The curved guide has a plurality of ball bearings. A reflector having front and back surfaces is capable of rotating about an elevation axis. A portion of the front surface of the reflector is concave and reflects microwave energy. At least one track is attached to the back surface of the reflector. The at least one track is positioned in and travels through the guide on the at least one cradle as the reflector rotates about the elevation axis. The reflector rotates about the azimuth axis with the rotation of the at least one cradle about the azimuth axis. The rotation of the reflector about the azimuth axis and about the elevation axis define a swept volume of the reflector. The at least one cradle is positioned on the rotary plate so that the at least one cradle is within the swept volume of the reflector. The positioning of the at least one cradle within the swept volume of the reflector prevents the at least one cradle from causing the swept volume of the microwave reflector antenna to be larger than the swept volume of the reflector.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a partial cross-sectional view of the microwave reflector antenna of FIG. 1 along line 3—3 showing the elevation motor and the gear rack on the reflector;

FIG. 4 is a partial cross-sectional view of the microwave reflector antenna of FIG. 1 along line 4—4 showing the azimuth motor;

FIG. 5 is a cross-sectional view of the guide and track on the microwave reflector antenna of FIG. 2 along line 5—5;

FIG. 6 is an exploded view of the guide bearing of the present invention.

DETAILED DESCRIPTION OF THE PREFERRED EMBODIMENTS

The following description of the preferred embodiment(s) is merely exemplary in nature and is in no way intended to limit the invention, its application, or uses.

Figure 1:
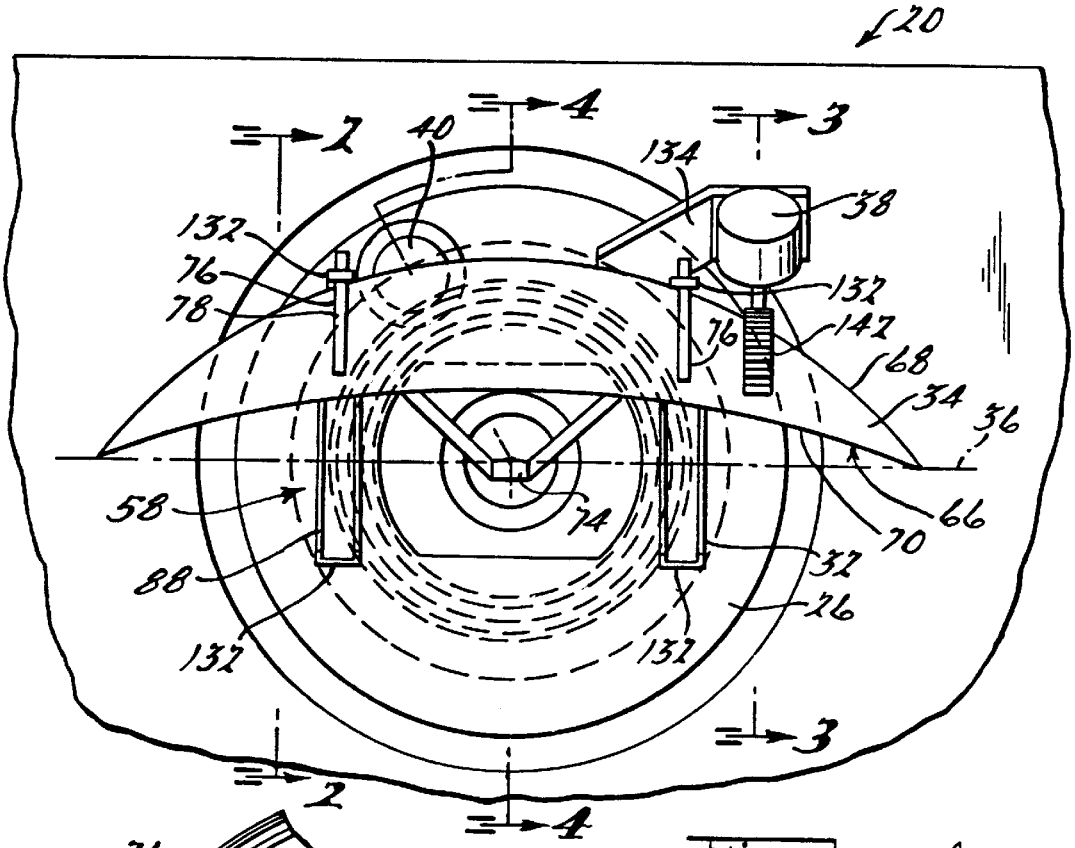
FIG. 1 is an overhead view of a microwave reflector antenna of the present invention.
Figure 2:
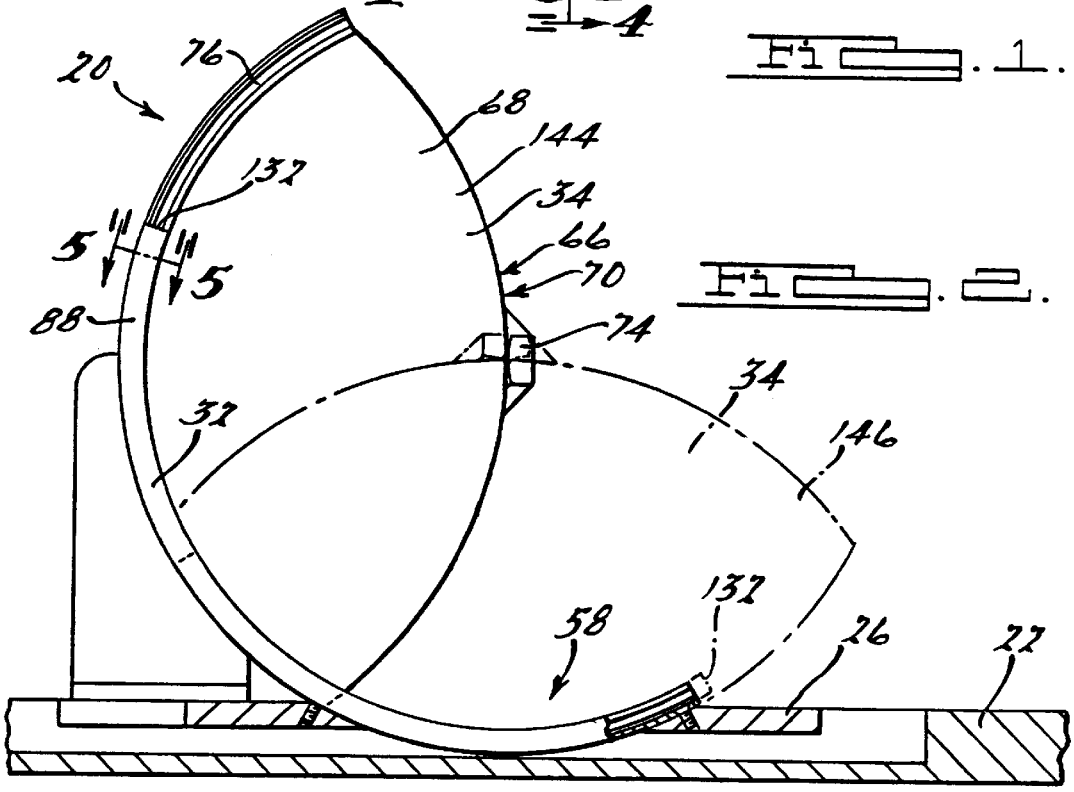
FIG. 2 is a partial cross-sectional view of the microwave reflector antenna of FIG. 1 along line 2—2 showing the reflector connected to the elevation cradle.
Figure 7:
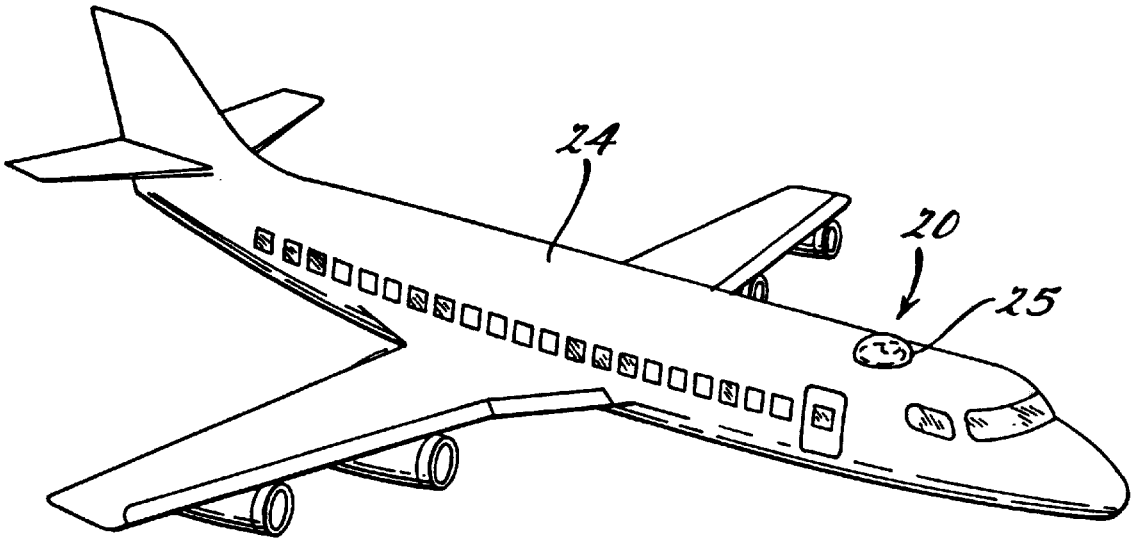
FIG. 7 is a perspective view of an aircraft having a microwave reflector antenna of the present invention mounted on the exterior of the aircraft and covered by a radome.

Referring to FIG. 2, a microwave reflector antenna 20 in accordance with a preferred embodiment of the present invention is shown. The microwave reflector antenna 20 is generally comprised of a stationary plate 22 which can be attached to an aircraft 24 (see FIG. 7) or any other surface upon which the microwave reflector antenna 20 is desired to be attached. As shown in FIG. 7, when the microwave reflector antenna 20 is attached to an aircraft 24, a radome 25 covers the microwave reflector antenna 20. Referring to FIG. 4, a rotary plate 26 is positioned above the stationary plate 22 and separated from the stationary plate 22 by a bearing 28. The rotary plate 26 is capable of rotating relative to the stationary plate 22. The rotary plate 26 rotates about an azimuth axis 30. At least one cradle 32 is attached to the rotary plate 26. The rotation of the rotary plate 26 about the azimuth axis 30 causes the cradle 32 to also rotate about the azimuth axis 30. A reflector 34 is operatively connected to the cradle 32 and travels along the cradle 32 as the reflector 34 rotates about an elevation axis 36 (see FIG. 1). An elevation motor 38 causes the reflector 34 to rotate about the elevation axis 36. An azimuth motor 40 causes the rotary plate 26 to rotate about the azimuth axis 30.

The stationary plate 22 has axially opposite top and bottom surfaces 42, 44 and an axial side wall 46 extending therebetween. The axial side wall 46 has gear teeth 48 that extend radially outward from the axial side wall 46. The bearing 28 is positioned in a circular recess 50 that extends axially into the top surface 42 of the stationary plate 22. The bearing 28 is a radial/thrust bearing that allows the rotary plate 26 to rotate about the azimuth axis 30.

As can be seen in FIG. 4, the rotary plate 26 has axially opposite top and bottom surfaces 52, 54. The bottom surface 54 has a circular projection 56 that extends axially outward from the bottom surface 54 of the rotary plate 26. The circular projection 56 is dimensioned to fit within the circular recess 50 in the stationary plate 22 along with the bearing 28. The rotary plate 26 has an opening 58 that extends axially through the rotary plate 26. The opening 58 is dimensioned to allow the reflector 34 and the cradle 32 to extend into the opening 58, as will be discussed in more detail below.

The azimuth motor 40 is attached to the top surface 52 of the rotary plate 26. A shaft 60 on the azimuth motor 40 extends through an opening (not shown) in the rotary plate 26. The shaft 60 extends beyond the bottom surface 54 of the rotary plate 26. A gear 62 is attached to the shaft 60 below the bottom surface 54 of the stationary plate 22. The gear 62 has teeth 64 that are complementary to and engage with the gear teeth 48 on the axial side wall 46 of the stationary plate 22. The azimuth motor 40 can be selectively operated to rotate the gear 62 and cause the rotary plate 26 to rotate about the azimuth axis 30. Preferably, the azimuth motor 40 is a stepper motor that allows precise control of the rotation of the gear 62 so that the rotation of the rotary plate 26 about the azimuth axis 30 can be precisely controlled.

As can be seen in FIG. 1, the reflector 34 has front and back surfaces 66, 68. A portion 70 of the front surface 66 is concave and reflects microwave energy that strikes the concave portion 70 of the front surface 66. Preferably, the back surface 68 of the reflector 34 is convex, however, the back surface 68 does not need to be convex to be within the scope of the invention. A wide band horn 72 is positioned on the front surface 66 of the reflector 34. A sub-reflector 74 is attached to the reflector 34 and is positioned in front of the horn 72. As is well known in the art, the horn 72 emits microwave energy which is directed at the sub-reflector 74. The sub-reflector 74 reflects the microwave energy towards the concave portion 70 of the front surface 66 of the reflector 34. The concave portion 70 of the front surface 66 of the reflector 34 then reflects the microwave energy in a desired direction.

While the microwave reflector antenna 20 is shown and described as having a single reflector with a concave portion on the front surface of the reflector, it should be understood that the microwave reflector antenna 20 could comprise an array of reflectors with an array of concave portions, subreflectors, and horns and be within the scope of the invention. Therefore, it is to be understood that the term reflector is not limited to a single reflector with a single concave portion and should be construed to include the situation where the reflector is one of a plurality of reflectors and/or a single reflector with an array of concave portions, subreflectors, and horns.

As can be seen in FIG. 4, at least one track 76 is attached to the back surface 68 of the reflector 34. The at least one track 76 can be integral to the back surface 68 of the reflector 34. That is, the back surface 68 and the at least one track 76 can be a single part that is monolithic with the back surface 68 and the at least one track 76 being made from a single piece of material. However, it should be understood that the at least one track 76 does not need to be integral to the back surface 68 of the reflector 34 to within the scope of the invention. The at least one track 76 is configured and adapted to travel through the cradle 32, as will be discussed in more detail below. Preferably, the at least one track 76 has an outer surface 78 and two side walls 80 that extend from the outer surface 78 toward the back surface 68 of the reflector 34. It is preferred that the side walls 80 on the at least one track 76 are parallel.

Preferably, the at least one track 76 is one of a plurality of tracks 76 that extend along the back surface 68 of the reflector 34. The tracks 76 are parallel to each other and are designed to ride in the cradle 32 so that the reflector 34 can rotate about the elevation axis 36, as will be described in detail below. The tracks 76 have a radius of curvature that determines the radius of the rotation of the reflector 34 about the elevation axis 36. The radius of curvature of the tracks 76 can be varied depending upon the type of reflector 34 that is to be rotated about the elevation axis 36. That is, different types of reflectors 34 may require a different radius of curvature of the tracks 76 to properly rotate about the elevation axis 36 and the tracks 76 can be made with a different radius of curvature to meet the needs of the different types of reflectors 34. Preferably, the radius of curvature of the tracks 76 is complementary to the convex back surface 68 of the reflector 34. The tracks 76 are positioned on the back surface 68 of the reflector 34 so that the tracks 76 are within the swept volume of the reflector 34.

As can be seen in FIG. 6, the tracks 76 have an arc length. Preferably, both of the side walls 80 on the track 76 have recesses 84 that extend into the side walls 80. The recesses 84 extend along the side walls 80 for the entire arc length of the tracks 76. The recesses 84 and the side walls 80 of the track 76 are dimensioned to allow ball bearings 86 to roll along the recesses 84 when the reflector 34 is rotated about the elevation axis 36, as will be described in more detail below.

Preferably, the at least one cradle 32 has a guide 88 attached to the at least one cradle 32. The guide 88 guides the reflector 34 as it rotates about the elevation axis 36. Preferably, the at least one cradle 32 is one of a plurality of cradles 32. Preferably, each cradle 32 of the plurality of cradles are either parallel to one another or in-line with one another so that the cradles 32 and its guides 88 can guide the reflector 34 as it rotates about the elevation axis 36. For example, some cradles 32 can be in-line so that a single track 76 travels through the guides 88 on the in-line cradles 32 when the reflector 34 rotates about the elevation axis 36. When the cradles 32 are parallel, a different track 76 will travel through the guides 88 on each of the parallel cradles 32 when the reflector 34 rotates about the elevation axis 36. The cradles 32 are positioned on the rotary plate 26 so that the cradles 32 are within the swept volume of the reflector 34. Including the cradles 32 within the swept volume of the reflector 34 prevents the cradles 32 from increasing the swept volume of the microwave reflector antenna 20 beyond the swept volume of the reflector 34 and, therefore, allows the swept volume of the microwave reflector antenna 20 to be minimized.

Preferably, the guide 88 on the cradle 32 is curved. Even more preferably, the curvature of the guide 88 is the same as a curvature of the track 76 on the back surface 68 of the reflector 34. The guide 88 is dimensioned to allow the track 76 to travel through the guide 88 as the reflector 34 rotates about the elevation axis 36. As can be seen in FIG. 6, the guide 88 has an arc length. Preferably, the arc length of the guide 88 is larger than the arc length of the track 76.

Preferably, the guide 88 has individual ball bearings 86 within the guide 88 and form a guide bearing 92 through which the track 76 on the back surface 68 of the reflector 34 travels as the reflector 34 rotates about the elevation axis 36. As can be seen in FIG. 5, the guide bearing 92 has a generally U-shaped channel 94. The channel 94 has a base 96 with radially opposite inner and outer surfaces 98, 100. Two side walls 102 extend radially from the base 96. Each side wall 102 has axially opposite inner and outer surfaces 104, 106. Preferably, the inner surface 104 of each of the side walls 102 has a recess 108 that extends axially from the inner surface 104 toward the outer surface 106. The recesses 108 extend along the arc length of the guide 88. The recesses 108 are dimensioned to allow ball bearings 86 to roll along the recesses 108 so that the track 76 on the back surface 68 of the reflector 34 can travel through the guide bearing 92. The inner surface 98 of the base 96 and the inner surfaces 104 of the two side walls 102 define an interior cavity 107 of the channel 94. The interior cavity 107 is dimensioned to allow the track 76 on the back surface 68 of the reflector 34 to travel through the interior cavity 107 of the channel 94 as the reflector 34 rotates about the elevation axis 36.

Preferably, the guide bearing 92 also has a retainer flange 110 positioned in the interior cavity 107 of the channel 94. As can be seen in figure 6, the retainer flange 110 is generally. U-shaped. The retainer flange 110 has a base 112 with radially opposite inner and outer surfaces 114, 116. The retainer flange 110 has two side walls 118 that extend radially from the base 112. Each side wall 118 of the retainer flange 110 has axially opposite inner and outer surfaces 120, 122. The retainer flange 110 has an arc length. Preferably, as shown in FIG. 6, the arc length of the retainer flange 110 is less than the arc length of the guide 88. The inner surface 114 of the base 112 and the inner surfaces 120 of the two side walls 118 form an interior cavity 126 of the retainer flange 110. The interior cavity 126 of the retainer flange 110 is dimensioned to allow the track 76 to fit within and travel through the interior cavity 126. Each of the side walls 118 on the retainer flange 110 have a plurality of openings 128 that are spaced along the arc length of the retainer flange 110. Preferably, the openings 128 are dimensioned to allow a portion 130 of an individual ball bearing 86 to extend through the opening 128.

The retainer flange 110 is positioned in the interior cavity 107 of the channel 94. Individual ball bearings 86 are positioned in the interior cavity 107 of the channel 94 between the outer surfaces 122 of the side walls 118 of the retainer flange 110 and the inner surfaces 104 of the side walls 102 of the channel 94 so that each ball bearing 86 is positioned in one of the openings 128 in the side walls 118 of the retainer flange 110 and in one of the recesses 108 in the inner surfaces 104 of the side walls 102 of the channel 94. As can be seen in FIG. 5, the portion 130 of each individual ball bearing 86 extends through one of the openings 128 in the side walls 118 of the retainer flange 110 and into the interior cavity 126 of the retainer flange 110. The retainer flange 110 holds the individual ball bearings 86 in the recesses 108 in the inner surfaces 104 of the side walls 102 of the channel 94. The retainer flange 110 can then move within the channel 94 along the arc length of the guide 88. The individual ball bearings 86 roll along the recesses 108 in the side walls 102 as the retainer flange 110 moves along the channel 94. The interior cavity 126 of the retainer flange 110 is dimensioned to allow the track 76 to fit within and travel through the interior cavity 126. When the track 76 is positioned in the interior cavity 126 of the retainer flange 110, the portions 130 of the ball bearings 86 that extend through the openings 128 in the side walls 118 of the retainer flange 110 are positioned in the recesses 84 in the side walls 80 of the track 76. The ball bearings 86 roll along the recesses 84 in the side walls 80 of the track 76 as the track 76 moves through the guide 88 as the reflector 34 rotates about the elevation axis 36.

As stated earlier, the arc length of the retainer flange 110 is less than the arc length of the guide 88 and is also less than the arc length of the track 76. The retainer flange 110 travels through the guide 88 as the track 76 travels through the interior cavity 126 of the retainer flange 110. The retainer flange 110 thereby facilitating the movement of the track 76 through the guide 88. In operation, the retainer flange 110 will move approximately one half of the distance the track 76 moves. In this manner, the retainer flange 118 moves along the arc length 40 of the guide 88 while the track 76 moves through the guide 88. Stops (not shown) are provided at each end 132 of the guide 88. The stops prevent the retainer flange 110 from travelling beyond the channel 94 of the guide 88.

The guide bearing 92 is thus formed by the channel 94, the retainer flange 110, the track 76 and the ball bearings 86. The recesses 108 on the inner surfaces 104 of the side walls 102 of the channel 94 function as outer races of the guide bearing 92. The recesses 84 in the side walls 80 of the track 76 function as inner races of the guide bearing 92. Preferably, the components of the guide bearing 92 are high precision components that are manufactured to close tolerances so that the reflector 34 does not deviate from a desired position as the reflector 32 rotates about the elevation axis 36.

The elevation motor 38 powers the rotation of reflector 34 about the elevation axis 36. The elevation motor 38 is attached to the rotary plate 26 by a bracket 134. However, it should be understood that the elevation motor 38 could be attached directly to the rotary plate 26 without departing from the scope of the invention. A shaft 136 extends from the elevation motor 38. A gear 138 is attached to the shaft 136 and has gear teeth (not shown). A support bearing 140 is attached to the bracket 134 and supports the shaft 136. A gear rack 142 is attached to the back surface. 68 of the reflector 34. The gear rack 142 has gear teeth (not shown) that are complementary to the gear teeth on the gear 138 of the elevation motor 38. Preferably, the gear rack 142 is parallel to the tracks 76 on the back surface 68 of the reflector 34. The elevation motor 38 is positioned so that the gear 138 is engaged With the gear rack 142 so that rotation of the gear 138 causes the gear rack 142 to travel along the gear 138 and the reflector 34 to rotate about the elevation axis 36. Preferably, the gear 138 and the gear rack 142 are a worm gear and a worm gear rack. The gear rack 142 is curved so that it matches the desired radius of curvature for the rotation of reflector 34 about the elevation axis 36. The gear rack 142 can be provided with a variety of curvatures to accommodate differing radius of curvatures for the rotation of the reflector 34 about the elevation axis 36. Preferably, the curvature of the gear rack 142, the curvature of the guide 38 and the curvature of the track 76 are all complementary to facilitate the rotation of the reflector 34 about the elevation axis 36.

The gear rack 142 can be integral to the back surface 68 of the reflector 34. That is, the gear rack and the back surface 68 can be a single monolithic part formed from a single piece of material. However, it should be understood that the gear rack 142 is not required to be integral to the back surface 68 to be within the scope of the invention. The operation of the elevation motor 38 controls the rotation of the reflector 34 about the elevation axis 36. Preferably, the elevation motor 38 is a high precision stepper motor that allows for precise control of the rotation of the gear 138 and the precise control of the rotation of reflector 34 about the elevation axis 36.

Preferably, the elevation motor 38 is positioned on the rotary plate 26 so that the elevation motor 38 is within the swept volume of the reflector 34. Also preferably, the gear rack 142, the gear 138 and the shaft 136 are also positioned within the swept volume of the reflector 34. In this manner, the elevation motor 38, the shaft 136 and the gear 138 along with the gear rack 142 are all within the swept volume of the reflector 34 and allow the swept volume of the microwave reflector antenna 20 to be minimized.

As can be seen in FIGS. 2 and 4, the reflector 34 rotates about the elevation axis 36 between the first and second positions 144, 146. The first position 144 corresponds to the reflector 34 looking outward along the horizon and the second position 146 corresponds to the reflector 34 looking upward to the sky. That is, the first position 144 corresponds to the front and back surfaces 66, 68 of the reflector 34 being generally perpendicular to the top surface 52 of the rotary plate 26 and the second position 146 corresponds to the front and back surfaces 66, 68 of the reflector 34 being generally parallel to the top surface 52 of the rotary plate 26. The reflector 34 is capable of being oriented in any position between the first and second positions 144, 146. As shown in the figures, the reflector 34 is capable of rotating approximately 900 about the elevation axis 36. However, it should be understood that the rotation of the reflector 34 about the elevation axis 36 can be increased beyond or decreased below 90° and be within the scope of the invention as defined by the claims.

The cradle 32 passes into the opening 58 in the rotary plate 26. When the reflector 34 rotates about the elevation axis 36 from the first position 144 to the second position 146, the reflector 34 also passes into the opening 58 and the rotary plate 26. The opening 58 in the rotary plate 26 allows the reflector 34 to be positioned closer to the rotary plate 26 and still rotate about the elevation axis 36. without interference with the radiated microwave energy. The ability to locate the reflector 34 close to the rotary plate 26 minimizes the extent to which the reflector 34 extends above the top surface 52 of the rotary plate 26 and reduces the swept volume of the reflector 34. The reduction in the swept volume of the reflector 34 allows the swept volume of the microwave reflector antenna 20 to be reduced.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A microwave reflector antenna with a reduced swept volume, the microwave reflector antenna comprising:

a rotary plate, the rotary plate being capable of rotating about an azimuth axis;

at least one elevation cradle, the at least one cradle being attached to the rotary plate so that rotation of the rotary plate about the azimuth axis causes the at least one cradle to rotate about the azimuth axis; and a reflector, the reflector traveling along the at least one cradle as the reflector rotates about an elevation axis, the reflector rotating about the azimuth axis with the rotation of the at least one cradle about the azimuth axis, the rotation of the reflector about the azimuth axis and about the elevation axis defining a swept volume of the reflector, and the at least one cradle being positioned on the rotary plate so that an entirety of the at least one cradle is within the swept volume of the reflector.

2. The microwave reflector antenna of claim 1, wherein:

the at least one cradle has a curved guide through which the reflector travels as the reflector rotates about the elevation axis.

3. The microwave reflector antenna of claim 2, wherein:

the rotary plate has an opening and a portion of the reflector passes into the opening when rotating about the elevation axis.

4. The microwave reflector antenna of claim 3, wherein:

the at least one cradle extends into the opening in the rotary plate.

5. The microwave reflector antenna of claim 2, wherein:

the reflector has front and back surfaces with at least a portion of the front surface being concave; and at least one track is attached to the back surface of the reflector, the at least one track connecting the reflector to the at least one cradle and traveling through the guide as the reflector rotates about the elevation axis.

6. The microwave reflector antenna of claim 5, wherein:

the at least one track is integral to the back surface.

7. The microwave reflector antenna of claim 5, wherein:

the guide on the at least one cradle has ball bearings and the at least one track travels through the guide and contacts the ball bearings as the reflector rotates about the elevation axis.

8. The microwave reflector antenna of claim 5, wherein:

the guide in which the at least one track travels has an arc length which is longer than an arc length of the at least one track.

9. The microwave reflector antenna of claim 5, wherein:

the at least one cradle is one of a plurality of cradles with each cradle of the plurality of cradles having a curved guide;

the at least one track is one of a plurality of tracks; and each track of the plurality of tracks travels through the guide on at least one cradle of the plurality of cradles as the reflector rotates about the elevation axis.

10. The microwave reflector antenna of claim 9, wherein:

each cradle of the plurality of cradles is generally parallel to the plurality of cradles and each track of the plurality of tracks is generally parallel to the plurality of tracks.

11. The microwave reflector antenna of claim 2, further comprising:

a gear rack attached to the reflector, the gear rack having gear teeth that extend along a length of the gear rack; and an elevation motor, the elevation motor having a gear with teeth that are complementary to and engaged with the gear teeth on the gear rack so that operation of the elevation motor causes the reflector to rotate about the elevation axis.

12. The microwave reflector antenna of claim 11, wherein:

the reflector has front and back surfaces with at least a portion of the front surface being concave; and the gear rack is integral to the back surface of the reflector.

13. A microwave reflector antenna with a reduced swept volume, the microwave reflector antenna comprising:

a rotary plate, the rotary plate being capable of rotating about an azimuth axis;

at least one elevation cradle, the at least one cradle having a curved guide with a plurality of ball bearings and being attached to the rotary plate so that rotation of the rotary plate about the azimuth axis causes the at least one cradle to rotate about the azimuth axis;

a reflector having front and back surfaces with a portion of the front surface being concave, the reflector being capable of rotating about an elevation axis, the reflector rotating about the azimuth axis with the rotation of the at least one cradle about the azimuth axis, the rotation of the reflector about the azimuth axis and about the elevation axis defining a swept volume of the reflector, and the at least one cradle being positioned on the rotary plate so that an entirety of the at least one cradle is within the swept volume of the reflector; and at least one track attached to the back surface of the reflector, the at least one track being positioned in and traveling through the guide on the at least one cradle as the reflector rotates about the elevation axis.

14. The microwave reflector antenna of claim 13, wherein:

the curved guide has an arc length and comprises a generally U-shaped channel, the channel having a base and two side walls that extend upwardly from the base, inner surfaces of the two side walls and the base defining an interior cavity of the channel through which the at least one track travels as the reflector rotates about the elevation axis, the inner surface of each side wall having a recess that extends along the arc length of the curved guide, and each recess being dimensioned to allow the plurality of ball bearings to roll along the recess as the at least one track travels through the interior cavity of the channel.

15. The microwave reflector antenna of claim 14, wherein:

the curved guide further comprises a generally U-shaped retainer flange with an arc length, the retainer flange being positioned in the interior cavity of the channel and having a base and two side walls that extend upwardly from the base, inner surfaces of the two side walls and the base defining an interior cavity of the retainer flange through which the at least one track travels as the reflector rotates about the elevation axis, each of the two side walls of the retainer flange having a plurality of openings spaced along the arc length of the retainer flange and extending through the side wall, each opening of the plurality of openings being dimensioned to allow a portion of a ball bearing of the plurality of ball bearings to fit through the opening; and the plurality of ball bearings are positioned in the interior cavity of the channel between the retainer flange side walls and the channel side walls with each ball bearing of the plurality of ball bearings being positioned in one of the recesses on the two channel side walls and in one opening of the plurality of openings in the two retainer flange side walls.

16. The microwave reflector antenna of claim 15, wherein:

the at least one track has an outer surface and two side walls that extend from the outer surface toward the back surface of the reflector, each of the two side walls having a recess that extends along an arc length of the at least one track, and the plurality of ball bearings roll along the recesses on the side walls of the at least one track as the at least one track travels through the interior cavity of the retainer flange.

17. The microwave reflector antenna of claim 16, wherein:

the arc length of the retainer flange is less than the arc length of the curved guide.

18. A method of reducing a swept volume of a microwave reflector antenna having a rotary plate that rotates about an azimuth axis and a reflector having at least one track and that rotates about an elevation axis and the azimuth axis and has a swept volume that is defined by the rotation of the reflector about the azimuth axis and about the elevation axis, the method comprising the steps of:

providing at least one cradle that the at least one track on the reflector can travel along and that guides the rotation of the reflector about the elevation axis;

attaching the at least one cradle to the rotary plate so that the at least one cradle rotates about the azimuth axis with the rotation of the rotary plate about the azimuth axis; and attaching the at least one track of the reflector to the at least one cradle so that the reflector can travel along the at least one cradle as the reflector rotates about the elevation axis and so that an entirety of the at least one cradle is within the swept volume of the reflector and a swept volume of the microwave reflector antenna can be reduced.

19. The method of claim 18, further comprising the step of:

providing an opening in the rotary plate through which a portion of the reflector can pass as the at least one track on the reflector travels along the at least one cradle and the reflector rotates about the elevation axis.

20. The method of claim 18, further comprising the steps of:

providing a curved guide on the at least one reflector; and providing ball bearings in the guide on the at least one cradle so that the at least one track on the reflector can pass through the curved guide and along the ball bearings as the reflector rotates about the elevation axis.

* * * * *